US009139403B2

(12) United States Patent
Lindberg

(10) Patent No.: US 9,139,403 B2
(45) Date of Patent: Sep. 22, 2015

(54) BRIDGE CRANE

(75) Inventor: Teppo Lindberg, Nuppulinna (FI)

(73) Assignee: KONECRANES OYJ, Hyvinkaa (FI)

( * ) Notice: Subject to any disclaimer, the term of this patent is extended or adjusted under 35 U.S.C. 154(b) by 306 days.

(21) Appl. No.: 13/574,278

(22) PCT Filed: Jan. 18, 2011

(86) PCT No.: PCT/FI2011/050034

§ 371 (c)(1),
(2), (4) Date: Sep. 26, 2012

(87) PCT Pub. No.: WO2011/089315

PCT Pub. Date: Jul. 28, 2011

(65) Prior Publication Data

US 2013/0032562 A1 Feb. 7, 2013

(30) Foreign Application Priority Data

Jan. 21, 2010 (FI) ..... 20105052

(51) Int. Cl.
*B66C 17/00* (2006.01)

(52) U.S. Cl.
CPC ..... *B66C 17/00* (2013.01)

(58) Field of Classification Search
CPC ..... B66C 17/00; B66C 19/00; B66C 21/04; B66C 2700/014; B66C 2700/018; B66C 11/12; B66C 11/16; B66C 11/18; B66C 9/14
USPC ..... 212/321, 312, 316, 319, 320, 322, 324, 212/325, 98, 99, 119, 328, 336–338; 254/334–338
See application file for complete search history.

(56) References Cited

U.S. PATENT DOCUMENTS

| | | | | | |
|---|---|---|---|---|---|
| 456,187 | A * | 7/1891 | Wood | 212/320 |
| 1,456,218 | A * | 5/1923 | Brightman | 212/95 |
| 3,190,456 | A * | 6/1965 | Holt et al. | 212/307 |
| 3,207,329 | A * | 9/1965 | Bevard | 414/143.2 |
| 3,834,552 | A * | 9/1974 | Lofink | 212/95 |
| 3,835,617 | A * | 9/1974 | Stock et al. | 53/428 |
| 3,946,881 | A * | 3/1976 | Ludvigsen | 212/307 |
| 4,730,743 | A * | 3/1988 | Rosman | 212/312 |
| 5,409,123 | A * | 4/1995 | Steiner | 212/312 |
| 5,626,247 | A * | 5/1997 | Hakala et al. | 212/325 |
| 6,561,368 | B1 * | 5/2003 | Sturm et al. | 212/319 |
| 7,073,673 | B2 * | 7/2006 | Takehara et al. | 212/323 |
| 7,721,869 | B2 * | 5/2010 | In 'T Hout | 198/313 |

FOREIGN PATENT DOCUMENTS

| | | |
|---|---|---|
| DE | 2 237 341 A1 | 3/1973 |
| DE | 131921 A1 | 8/1978 |

(Continued)

*Primary Examiner* — Emmanuel M Marcelo
*Assistant Examiner* — Justin Stefanon
(74) *Attorney, Agent, or Firm* — Birch, Stewart, Kolasch & Birch, LLP

(57) ABSTRACT

The object of the invention is a bridge crane, which comprises a main girder, which is fitted to travel supported by end carriages essentially at both ends and which bridge crane further comprises a hoisting trolley traveling supported by the main girder and a rope drum mounted on bearings to rotate in an essentially stationary position, from which rope drum the hoisting rope is guided to a hook traveling along with the hoisting trolley. The hoisting rope is supported from below for at least a part of its essentially horizontal section.

16 Claims, 4 Drawing Sheets

(56) References Cited

FOREIGN PATENT DOCUMENTS

| | | | |
|---|---|---|---|
| DE | 39 37 080 | A1 | 5/1991 |
| EP | 1 076 033 | A1 | 2/2001 |
| FR | 2 038 746 | A5 | 1/1971 |
| GB | 1 200 075 | | 7/1970 |
| JP | 2-243494 | A | 9/1990 |
| NL | 7801497 | A | 5/1979 |
| SU | 639802 | A1 | 12/1978 |
| SU | 1399257 | A1 | 5/1988 |

* cited by examiner

BRIDGE CRANE

The object of the invention is a bridge crane as defined in the claims.

BACKGROUND OF THE INVENTION

Bridge cranes according to prior art generally comprise two main girders that are at a distance from each other and a trolley comprising the hoisting machinery of the crane, said machinery traveling along with the trolley, and said trolley fitted to travel on rails on top of the girders. One problem, among others, in this solution is the expensive, wide and heavy structure. Two main girders cause both material costs and additional construction-time costs owing to the amount of work needed for manufacturing. Additionally, the trolley must be heavily built and robust in order to withstand the stressing caused by the hoisting machinery. The width of the structure is again a problem in connection with the handling of the material to be lifted. In this case one problem, among others, is that two bridge cranes cannot necessarily be brought close enough together so that large-sized objects could e.g. be turned by means of the cranes.

Also known in the art are bridge cranes which comprise only one main girder and in which the hoisting machinery with its rope drum is rigidly in its position with respect to the main girder. One such structure is presented in British patent no. GB1200075. It presents a single-beam bridge crane, in which both ends of the main girder comprise an end carriage provided with rail wheels, and in which crane the rope drum of the hoisting machinery is fixed into its position on the side wall of the second end carriage. On one side of the main girder is a hoisting trolley, movable in the longitudinal direction of the main girder, to which hoisting trolley the hoisting ropes are guided from the rope drum such that the hoisting rope from the rope drum that is fixed on the first end carriage is guided at first to the diverting pulley on the second end carriage and after passing around it to the hoisting trolley and to the hook and onwards via a diverting pulley on the hoisting trolley back to the first end carriage, to which the free end of the rope is fixed. The rope forces of the hoisting rope that act on the hoisting trolley are compensated in the direction of the hoisting rope and in the lateral direction. Compensation in the lateral direction is implemented such that the diverting pulleys of the hoisting trolley are on the same vertical plane as each other. A problem in this type of structure is the sagging of the long horizontal section of the hoisting rope, which sagging is often disturbingly large from the viewpoint of the user. The reason for the occurrence of the sagging is mainly that the weight of the lifting hook and its rope pulleys is not sufficient to tension the hoisting rope. When the load is fastened to the lifting hook at first in the hoisting phase it always takes the hoisting machinery some time before the slack rope caused by sagging has tightened. This can be dangerous if one cannot be prepared for it, and also in installation work, in which the crane is used for precise lifting, the slackness of the rope caused by sagging is awkward.

SUMMARY OF THE INVENTION

The aim of this invention is to eliminate the aforementioned drawbacks and to achieve a bridge crane that is cheap in its costs and which is structurally essentially narrow and space-saving in the direction of travel of the crane. Another aim is to achieve a reeving solution of a bridge crane in which there is no sagging of the hoisting ropes or it is very small, in which case lifting the load is precise and dangerous situations cannot arise owing to slackness of the rope caused by the sagging of the hoisting rope at the start of the hoisting phase. The bridge crane according to the invention is characterized by what is disclosed in the characterization part of claim 1. Other embodiments of the invention are characterized by what is disclosed in the other claims.

One advantage of the bridge crane solution according to the invention is that the sagging produced by the weight of the hoisting ropes does not occur, in which case the dangerous situations at the start of lifting caused by slackness of the rope resulting from the sagging is avoided. Likewise, the lifting work is very precise owing to the absence of sagging. Another advantage is that when the hoisting ropes are placed on top of the main girder, the hoisting trolley side of the main girder is free e.g. for the current supply of the traveling machinery of the hoisting trolley. Since the hoisting trolley does not comprise hoisting machinery, another advantage is also that it is not necessary to bring a heavy-duty electricity supply required by the hoisting machinery to the hoisting trolley, but instead a supply to the traveling machinery that does not need large electric cables for its electricity supply is sufficient for the electricity supply. In addition, compensation of the rope forces of the hoisting rope reduces the stressing on the hoisting trolley caused by the hoisting rope, which in turn helps to reduce the size of the traveling machinery. Another advantage is that by means of the solution according to the invention a long rope drum of essentially small diameter can be used, but despite this the crane can be narrow in its direction of travel. Thus a narrow crane is achieved with which large loads can be lifted, because a lot of rope fits onto the rope drum, which in turn enables a large rope transmission in the rope blocks of the hoisting trolley. A narrow crane also gives the advantage that e.g. two similar bridge cranes can be driven very close to each other. In this case they can together handle very large objects.

BRIEF DESCRIPTION OF THE DRAWINGS

In the following, the invention will be described in more detail by the aid of examples of its embodiments with reference to the attached drawings, wherein.

DETAILED DESCRIPTION

Figure 1:
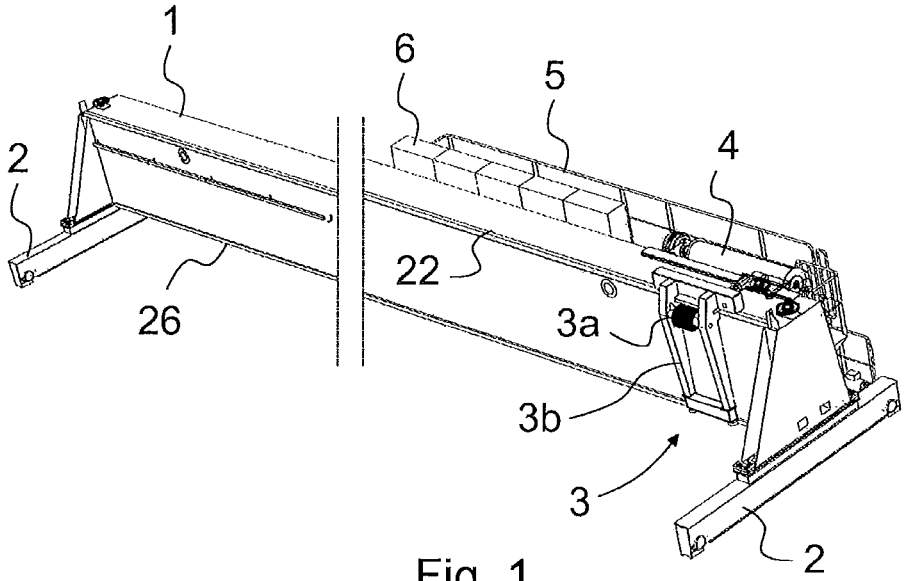
FIG. 1 presents an oblique top view of one bridge crane according to the invention, simplified and sectioned, and without hoisting ropes.

FIG. 1 presents an oblique top view of one simplified and also sectioned bridge crane according to the invention without the hoisting ropes, hook and some other parts belonging to the solution, which parts are described later. The bridge crane is a so-called torsional bridge crane and it comprises one main girder 1, at both ends of which is an end carriage 2 provided with at least rail wheels and traveling machinery. A hoisting trolley 3 is fitted in connection with the first side of the main girder, which trolley travels on the first side of the main girder in the lateral direction with respect to the direction of travel of the main girder 1. The hoisting trolley 3 comprises a rope block 3*a* for the hoisting ropes and a frame part provided with legs 3*b*, which frame part rests on guide rails 22 and 26 in the longitudinal direction of the main girder, which guide rails are on top of the main girder 1 and on the bottom edge of the first side of the main girder 1. The structure of the hoisting trolley 3 and the guide rails are described in more detail in connection with FIG. 7. In addition, the bridge crane comprises a rope drum 4, which is mounted in its position on bearings near the first end of the main girder 1 and on the second side, i.e. on the opposite side to the hoisting trolley 3, of the main girder 1. A service platform 5 as well as the electrical cubicles and control cubicles 6 needed for controlling the crane are also in connection with the rope drum 4.

Figure 2:
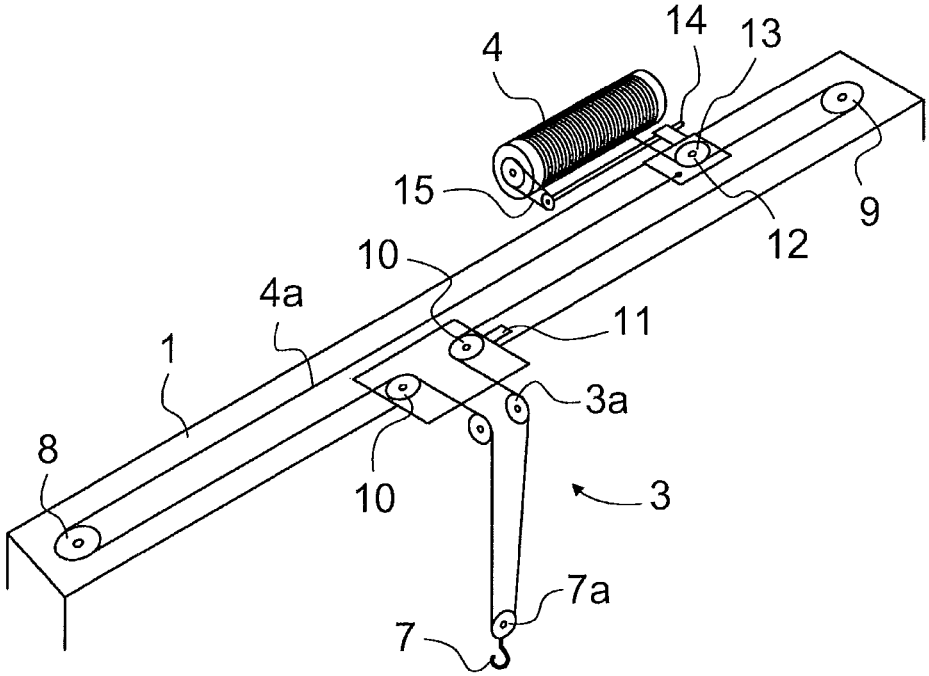
FIG. 2 presents a simplified and diagrammatic oblique top view of one reeving arrangement of a bridge crane according to the invention.

FIG. 2 presents a simplified and diagrammatic oblique top view of a reeving arrangement of a bridge crane according to FIG. 1. In it the hoisting rope 4*a* is guided from the rope drum 4 first to the diverting pulley 13, which is mounted with bearings on a vertical axis, of the guide trolley 12 that moves on its trajectory in the axial direction of the rope drum, after passing over which diverting pulley the hoisting rope 4*a* is guided to the diverting pulley 9, which has a vertical axis, at the first end of the main girder 1, after passing over which onwards back to the hoisting trolley 3 provided with traveling machinery 11. In addition, the apparatus comprises observation means for inspecting the tension of the hoisting rope 4*a* to be guided from the rope drum 4 into the rope channel. If the weight of the hook 7 is not able to keep the hoisting rope taut for some reason, the observation means stop the lowering of the hook 7 downwards.

The hoisting trolley 3 comprises two diverting pulleys 10 with vertical axes, of which diverting pulleys the first is fitted to take the hoisting rope 4*a* from its channel to the lifting hook 7. In this case the hoisting rope 4*a* is guided over the first diverting pulley 10 at essentially approximately 90° to the rope block 3*a* with an essentially horizontal axis, which block is on the hoisting trolley, and which rope block can comprise a number of diverting pulleys side by side depending on the reeving solution of the crane. From the first diverting pulley of the rope block 3*a* the hoisting rope 4*a* descends to the first diverting pulley of the rope block 7*a* that is in connection with the hook 7, after passing below which the hoisting rope 4*a* ascends to the second diverting pulley of the rope block 3*a* of the hoisting trolley. If there are more than two diverting pulleys in the rope block 3*a*, the hoisting rope 4*a* descends after passing over the second diverting pulley again to the rope block 7*a* that is in connection with the hook 7 and to the second diverting pulley in it and continuing in this way alternately downwards and upwards until all the diverting pulleys of the rope blocks 3*a* and 7*a* have been passed around. When the hoisting rope 4*a* ascends for the last time to the rope block 3*a* of the hoisting trolley 3, it passes over the free diverting pulley towards the second diverting pulley 10 of the hoisting trolley 3, which diverting pulley 10 has a vertical axis and with which diverting pulley the hoisting rope 4*a* is guided to turn essentially approx. 90° back into its rope channel to be essentially in the longitudinal direction of the main girder 1. After this the hoisting rope 4*a* is guided to the diverting pulley 8, which has a vertical axis, at the second end of the main girder 1, after passing over which onwards back to the guide trolley 12, to which the free end of the hoisting rope 4*a* is fixed. Thus the rope forces acting in the hoisting rope 4*a* are compensated both in the hoisting trolley 3 and in the guide trolley 12.

The guide trolley 12 is fitted to slide on its own guide rails on top of the main girder 1 essentially in the longitudinal direction of the main girder and for essentially the same distance that the hoisting rope 4*a* to be discharged from the rope drum 4 and to be coiled onto the rope drum 4 moves when lowering and raising the hook 7 in the axial direction of the rope drum 4 when guided by the grooves of the rope drum 4. In this case the hoisting rope 4*a* discharges from the rope drum 4 and correspondingly coils onto the rope drum 4 in a direction that is at essentially a right angle to the axis of rotation of the rope drum 4, in which case no skewed pulling on the rope drum 4 occurs. This enables a rope drum 4 that is long in the axial direction and that is of as small a diameter as possible to be used in the solution according to the invention. The movement of the guide trolley 12 is implemented e.g. by the aid of a screw means 14, which is rotated in synchronization with the rotational movement of the rope drum 4 by the aid of a chain 15, which receives its driving force from the rotational movement of the rope drum 4.

Figure 3:
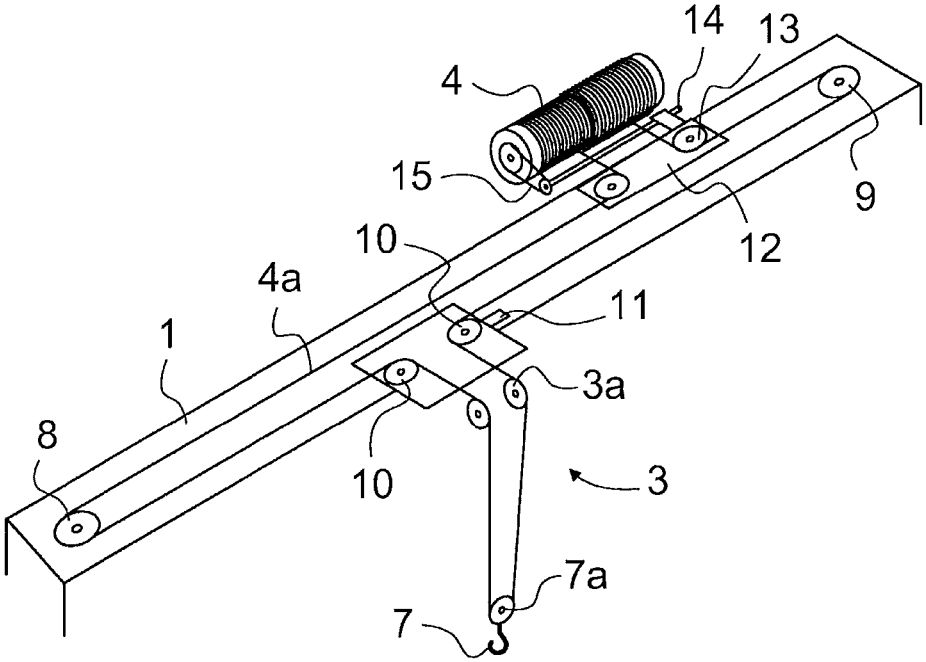
FIG. 3 presents a simplified and diagrammatic oblique top view of a second reeving arrangement of a bridge crane according to the invention.
Figure 4:
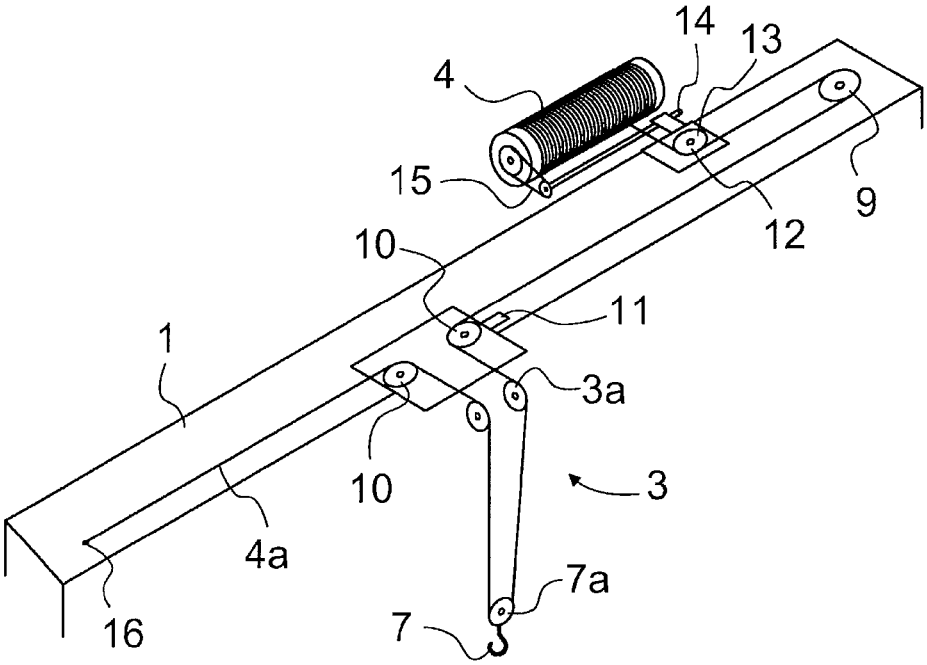
FIG. 4 presents a simplified and diagrammatic oblique top view of a third reeving arrangement of a bridge crane according to the invention.
Figure 5:
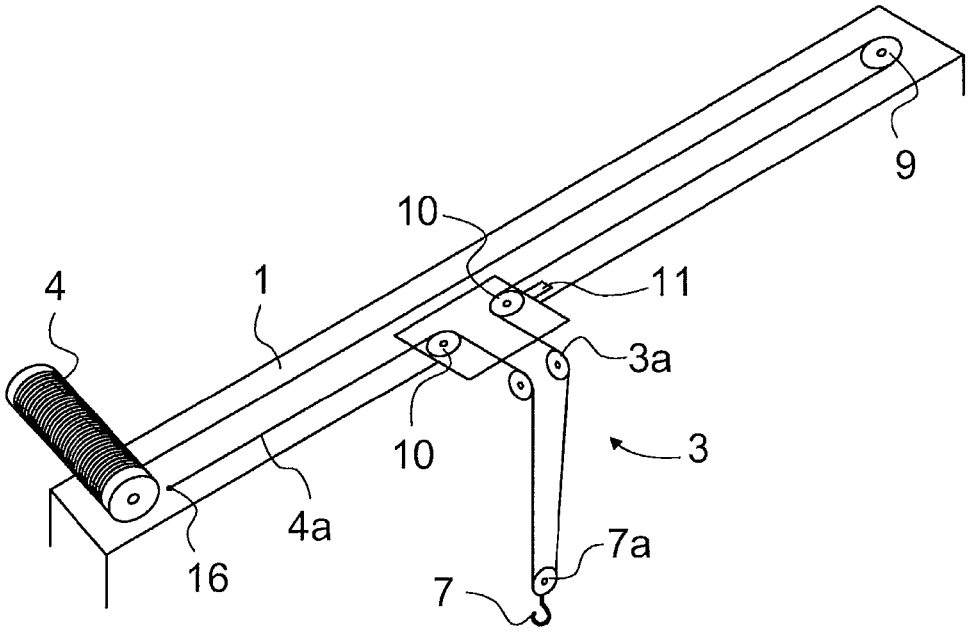
FIG. 5 presents a simplified and diagrammatic oblique top view of one more reeving arrangement of a bridge crane according to the invention.

FIGS. 3-5 present different reeving solutions of a bridge crane according to the invention for guiding the hoisting rope from a fixed-location rope drum 4 to the lifting hook 7 and back to its fixing location of the second end.

The solution according to FIG. 3 differs from the solution presented by FIG. 2 only in that both ends of the hoisting rope 4*a* are fixed to the rope drum 4. In this case the guide trolley 12 comprises, instead of one diverting pulley 13, two diverting pulleys 13 and 13*a* mounted on a vertical axis on bearings, which diverting pulleys guide the hoisting rope 4*a* from the rope drum 4 to on top of the main girder 1 and from there back to the rope drum 4. In the solution according to FIG. 3 the hoisting rope 4*a* is also coiled onto the rope drum 4 in two layers. In this reeving arrangement also the rope forces acting in the hoisting rope 4*a* are compensated both in the hoisting trolley 3 and in the guide trolley 12.

The solution according to FIG. 4 differs from the solution presented by FIG. 2 in that there is a saving in the length of the hoisting rope 4*a* when the free end of it is not guided back to the guide trolley 12, but instead the free end is fixed to its fixing location 16 at the second end of the main girder 1. In this case the rope forces of the hoisting rope 4*a* must be compensated in a different way in the guide trolley 12. The compensation is now implemented with a sufficiently strong screw 14, which receives the rope forces of the hoisting rope 4*a*. On the other hand, the compensation of the rope forces of the hoisting rope in the hoisting trolley 3 is made in this solution in the same way as is described above in connection with FIGS. 2-3.

The solution according to FIG. 5 differs from the solution presented by FIG. 2 in that the rope drum 4 is placed transversely with respect to the longitudinal direction of the main girder 1. In this solution the hoisting rope 4*a* leaving the rope drum 4 can now leave directly from the rope drum 4 without a 90° turn into the direction of the main girder 1. This solution can also comprise a guide trolley suited to the purpose, which trolley guides the hoisting rope 4*a* in the right direction into a rope channel on top of the main girder 1, but when the starting end of the rope channel is wide enough, a guide trolley is not necessarily needed. In this solution the hoisting rope 4*a* is guided from the rope drum 4 at the second end of the main girder 1 first over the diverting pulley 9, which has a vertical axis, at the first end of the main girder 1 and after passing around this to the hoisting trolley 3 and to the lifting hook 7 in the manner described in connection with FIG. 2, and also onwards after passing around the second diverting pulley 10, which has a vertical axis, of the hoisting trolley 3 to its fixing location 16 near the second end of the main girder 1.

Figure 6:
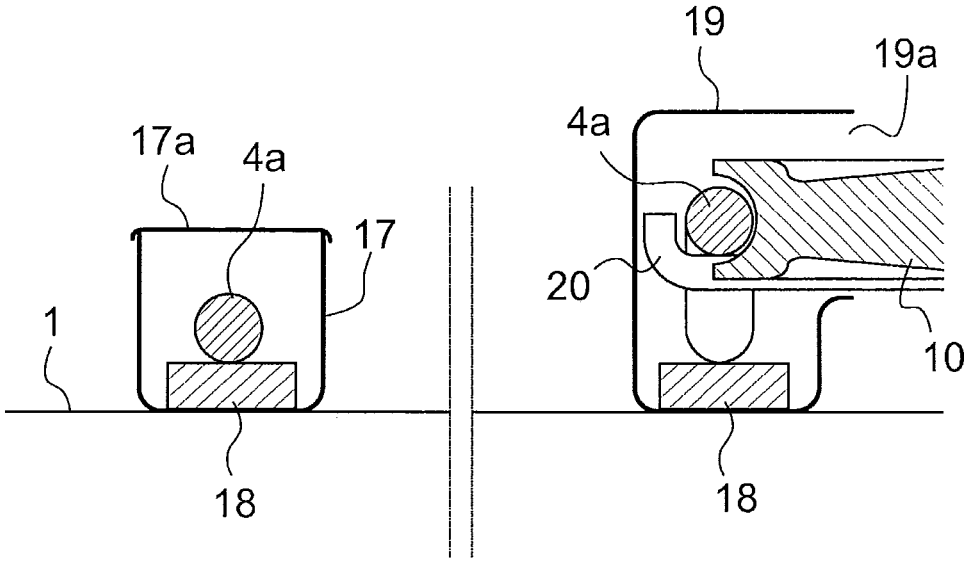
FIG. 6 presents the rope channels on top of the main girder of a bridge crane according to the invention, simplified and sectioned.

FIG. 6 presents the simplified and sectioned rope channels 17 and 19 that are on top of the main girder 1 of a bridge crane according to the invention. The rope channels 17 and 19 are in use in all the solution models presented above, although for the sake of clarity they are not shown in the previous figures. In the solution presented by FIG. 5 the rope channel 17 differs from the rope channel 17 of the other solutions because it must be wider at its end on the rope drum 4 side, because the hoisting rope now moves in the direction of travel of the main girder 1 when it discharges from the rope drum 4 and when it coils onto the rope drum 4.

The rope channels 17 and 19 do not need to be of the whole length of the main girder 1 and they do not need to be unbroken, in which case they can be shorter parts one after the other. The rope channel 17 on the side leaving from the rope drum 4 and coming to the rope drum is a simple channel, which is fixed on top of the main girder 1 in essentially the longitudinal direction of the main girder 1. The base of the rope channel 17 has a slide lining 18 of friction-reducing material, which lining can be e.g. of plastic or can also consist of small rollers. The hoisting rope 4*a* is fitted into the rope channel 17 onto the top of the slide lining 18. Additionally, the rope channel 17 comprises a cover 17*a*, with which the rope channel 17 is enclosed from the top for preventing the entry of dust and dirt into the rope channel.

Correspondingly, the rope channel 19 is intended for supporting and protecting the parts of the hoisting rope 4*a* on the hoisting trolley 3 side. The base of the rope channel 19 has the same type of slide lining 18 as is in the rope channel 17. The rope channel 19 is fixed on top of the main girder 1 in essentially the longitudinal direction of the main girder 1 and beside the path of movement of the hoisting trolley 3 such that a part of the outer rim of the diverting pulleys 10 of the hoisting trolley 3 is inside the rope channel 19 during the traveling motion of the hoisting trolley 3. In order to enable this, the rope channel 19 opens to the side in the direction of the hoisting trolley 3 such that the aperture 19*a* opening in the direction of the hoisting trolley 3 is on the top edge of the rope channel 19 and is larger in height than the thickness of the diverting pulleys 10 on the hoisting trolley 3. The hoisting trolley 3 also comprises a guide means 20, the free end of which is fitted to move in the rope channel 19 through an aperture 19*a* and to lift the hoisting rope 4*a* from on top of the slide lining 18 to the height of the diverting pulleys 10 when the hoisting trolley 3 moves on its track. The rope channel 19 is placed in relation to the path of movement of the hoisting trolley 3 and of the guide means 20 e.g. such that when the hoisting trolley 3 moves the rope groove of the diverting pulleys 10 is essentially at the same height as the hoisting rope 4*a*.

Figure 7:
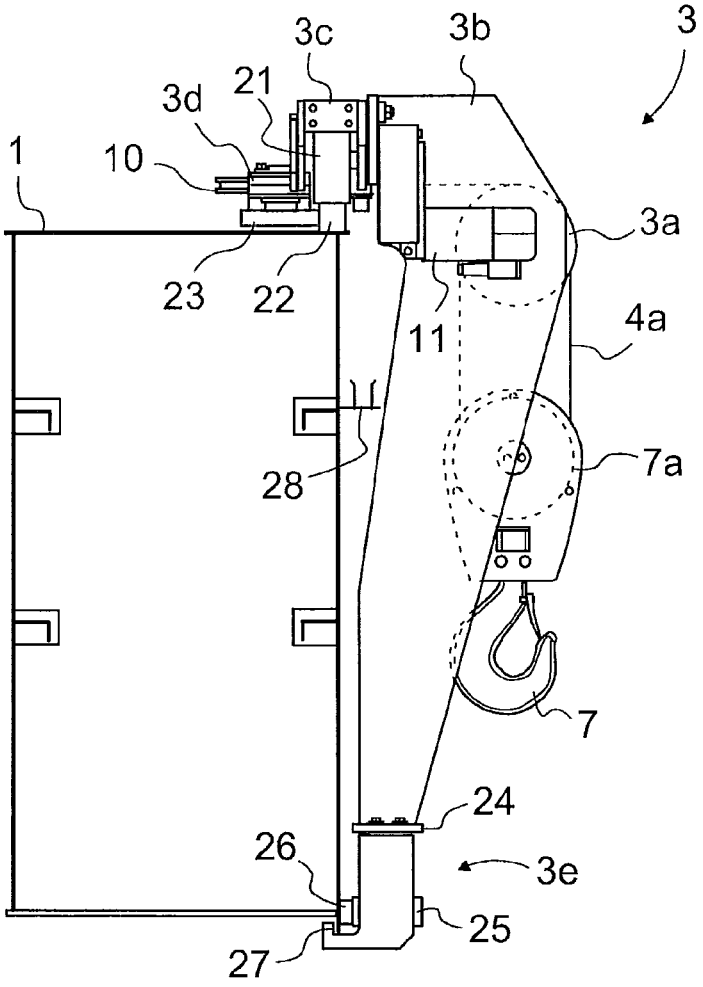
FIG. 7 presents the main girder of a bridge crane according to the invention, as viewed from the end of the main girder and when sectioned and partly simplified.

FIG. 7 presents one sectioned and partly simplified main girder 1 of a bridge crane according to the invention, as viewed from the end of the main girder. Among others, the aforementioned rope channels 17 and 19, the rope drum 4 and other structures are omitted from FIG. 7. The main girder 1 is a box beam, of essentially rectangular cross-sectional shape, assembled from plates. A first guide rail 22 in essentially the longitudinal direction of the main girder 1 is fixed to the first edge of the top surface of the main girder 1, the support surface of which guide rail is essentially horizontal. Correspondingly, a second guide rail 26 also in essentially the longitudinal direction of the main girder 1 is fixed to the bottom edge of the first side plate of the main girder 1, the support surface of which guide rail is essentially vertical. The hoisting trolley 3 is fitted to travel along the guide rails 22 and 26 supported by its rail wheels 21 and 25, of which rail wheels 21 and 25 there are two units of each. In addition, the first side plate of the main girder 1 comprises a channel 28 in essentially the longitudinal direction of the main girder 1 for the current supply cable of the hoisting trolley.

The hoisting trolley 3 comprises two essentially vertical legs 3*b* that are at a horizontal distance from each other and an essentially horizontal box beam 3*c* on the top part of the legs 3*b* and connecting the legs 3*b*, which legs and box beam together form the frame part of the hoisting trolley. Additionally, an essentially horizontal beam structure connects the bottom parts 3*e* of the legs 3*b*. The bottom end of the legs 3*b* comprises an extension means 24, to which the bottom parts 3*e* of the legs, said parts being of different heights, can be fixed so that the height of the hoisting trolley 3 can be fitted to be suited to main girders 1 of different heights.

Rail wheels 21 mounted on bearings onto the box beam 3*c* are inside the box beam 3*c* of the hoisting trolley 3 at both ends of the box beam, which rail wheels are fitted to travel on a guide rail 22. Traveling machinery 11 is fixed to both rail wheels 21 or to only one rail wheel 21 for moving the hoisting trolley 3 in the longitudinal direction of the main girder 1. In addition, two support wheels 23 mounted on a vertical axis on bearings are fixed to the box beam 3*c*, which support wheels are fitted to rest on the vertical rear surface of the guide rail 22, which rear surface is on the opposite side of the guide rail 22 to the main structure of the hoisting trolley with its hook 7 and rope blocks. Also a separate support frame 3*d* is fixed to the rear part of the box beam 3*c*, onto which support frame two diverting pulleys 10 are mounted on a vertical axis on bearings for guiding the hoisting rope from on top of the main girder 1 to the lifting hook 7 and from the lifting hook back to on top of the main girder 1 into the direction of the main girder.

In addition, the bottom ends of the legs 3*b* of the hoisting trolley 3 comprise safety lugs 27, which are fitted to rest on the extended rear surface of the first side plate of the main girder 1 if the bottom ends of the legs 3*b* of the hoisting trolley try to detach from the support of the guide rail 26. Corresponding safety lugs can also be at the top end of the hoisting trolley 3, in which case the safety lugs shape-lock to the rearmost vertical surface of the guide rail 22. The safety lugs are situated on the front edge of the main girder 1 so that the rear surface of the main girder 1 would remain free for other devices.

Between the legs 3*b* of the hoisting trolley 3 is a rope block 3*a* functioning as a diverting pulley block mounted on a horizontal axis on bearings, which rope block comprises at least two diverting pulleys, but depending on the rope transmission often more than two, e.g. 4, 6, 8, 10, 12, etc. Correspondingly, the hook 7 generally comprises the same type of rope block 7*a* functioning as a diverting pulley block, which rope block comprises one less diverting pulley than the upper rope block 3*a*, thus e.g. 1, 3, 5, 7, 9, 11, etc. The hoisting rope 4*a* is guided to the upper rope block 3*a* via the first diverting pulley 10 and, after passing around the diverting pulleys of the rope blocks 3*a* and 7*a*, the hoisting rope 4*a* is guided from the upper rope block 3*a* back to on top of the main girder 1 via the second diverting pulley 10.

One main idea of the invention is that the hoisting rope 4*a* leaving from the rope drum 4 is supported from below, in which case sagging caused by the weight of the hoisting rope does not come to the hoisting rope 4*a*, the so-called slack rope section caused by which sagging would first always have to be removed at the start of a hoisting operation. It is advantageous to support the hoisting rope 4*a* on the top of the main girder 1, but it can be supported e.g. in its own channel also on the side of the main girder 1. Thus in the solution according to the invention the horizontal hoisting rope sections are essentially continuously supported from below the hoisting ropes.

It is obvious to the person skilled in the art that the invention is not limited solely to the example described above, but that it may be varied within the scope of the claims presented below. Thus, for example, the rope arrangements of the hoisting rope and the structure of the hoisting trolley can also be different to what is described above. There can be e.g. two or more hoisting trolleys instead of the one presented.

It is further obvious to the person skilled in the art that the structure and operation of the guide trolley that is in connection with the rope drum can be different to what is described above.

It is also obvious to the person skilled in the art that the hoisting trolley can, instead of the guide means presented, comprise roller-type lifting means or wedge-shaped ramps that lift the hoisting rope from the bottom of the rope channel to the height of the diverting pulleys when the hoisting trolley moves on its track.

The invention claimed is:

1. A bridge crane, comprising:

a main girder extending along an axis and supported by end carriages essentially at both ends of the axis of the main girder such that the main girder travels along a direction perpendicular to said axis;

a hoisting trolley configured to travel along the axis and supported by the main girder:

a pair of rope channels positioned on top of the main girder and extending parallel to the axis of extension of the main girder: and a rope drum mounted on bearings to rotate in an essentially stationary position, from which rope drum a hoisting rope is guided to a hook traveling along with the hoisting trolley, and which hoisting rope is supported from below by the pair of rope channels for at least a part of an essentially horizontal section of the hoisting rope.

2. Bridge crane according to claim 1, wherein each of the pair of rope channels includes a slide lining, which is placed under the hoisting rope and is closed from above.

3. Bridge crane according to claim 2, wherein the slide lining is of plate-like plastic or consists of rollers mounted on bearings.

4. Bridge crane according to claim 3, wherein the rope drum is mounted to the main girder on bearings such that the rope drum rotates around an axis parallel to the axis of extension of the main girder.

5. Bridge crane according to claim 3, further comprising:

at least one guide pulley in connection with the main girder for guiding passage of the hoisting rope when the hoisting rope discharges from the rope drum and when the hoisting rope coils onto the rope drum, the at least one guide pulley having an axis of rotation perpendicular to the axis of rotation of the rope drum.

6. Bridge crane according to claim 2, wherein the slide lining is of plate-like plastic or consists of rollers mounted on bearings.

7. Bridge crane according to claim 2, wherein the rope drum is mounted to the main girder on bearings such that the rope drum rotates around an axis parallel to the axis of extension of the main girder.

8. Bridge crane according to claim 2, further comprising:

at least one guide pulley in connection with the main girder for guiding passage of the hoisting rope when the hoisting rope discharges from the rope drum and when the hoisting rope coils onto the rope drum, the at least one guide pulley having an axis of rotation perpendicular to the axis of rotation of the rope drum.

9. Bridge crane according to claim 1, wherein the rope drum is mounted to the main girder on bearings such that the rope drum rotates around an axis parallel to the axis of extension of the main girder.

10. Bridge crane according to claim 9, further comprising:

at least one guide pulley in connection with the main girder for guiding passage of the hoisting rope when the hoisting rope discharges from the rope drum and when the hoisting rope coils onto the rope drum, the at least one guide pulley having an axis of rotation perpendicular to the axis of rotation of the rope drum.

11. Bridge crane according to claim 1, further comprising:

at least one guide pulley in connection with the main girder for guiding passage of the hoisting rope when the hoisting rope discharges from the rope drum and when the hoisting rope coils onto the rope drum, the at least one guide pulley having an axis of rotation perpendicular to the axis of rotation of the rope drum.

12. Bridge crane according to claim 1, wherein a top part of the hoisting trolley comprises diverting pulleys mounted on bearings for guiding the hoisting rope from on top of the main girder to the lifting hook and from the lifting hook back to on top of the main girder and also for compensating the rope forces of the hoisting rope in the hoisting trolley, the diverting pulleys having an axis of rotation perpendicular to the axis of extension of the main girder.

13. Bridge crane according to claim 12, wherein one of the pair of rope channels includes an aperture such that a part of an outer rim of the diverting pulleys in the hoisting trolley is inside the rope channel.

14. Bridge crane according to claim 13, wherein the hoisting trolley comprises a guide means having a free end which is fitted to move in the rope channel through the aperture and to lift the hoisting rope from on top of a slide lining within the rope channel to a height of a rope grooves of the diverting pulleys when the hoisting trolley moves.

15. Bridge crane according to claim 1, wherein the rope forces acting in the hoisting rope are compensated in a guide trolley that is in connection with the rope drum in at least one of the following ways: by fixing a free end of the hoisting rope to the guide trolley; by guiding a free end of the hoisting rope via a second diverting pulley on the guide trolley back to the rope drum; by the aid of a screw means fixed to the guide trolley.

16. Bridge crane according to claim 1, wherein the hoisting trolley includes a pair of legs extending in a direction perpendicular to the axis of extension of the main girder, a bottom end of each of the legs of the hoisting trolley comprises an extension means for fixing bottom parts of the legs, said parts being of different heights, to the hoisting trolley for fitting the height of the hoisting trolley to be suited to main girders of different heights.

* * * * *